US005085437A

United States Patent [19]

Leitao

[11] Patent Number: 5,085,437

[45] Date of Patent: * Feb. 4, 1992

[54] CHIPPING AND PUTTING PRACTICE DEVICE

[76] Inventor: Joseph F. Leitao, 500 Foggy Ridge Pkwy., Lutz, Fla. 33549

[ * ] Notice: The portion of the term of this patent subsequent to Aug. 20, 2008 has been disclaimed.

[21] Appl. No.: 695,461

[22] Filed: May 3, 1991

Related U.S. Application Data

[63] Continuation-in-part of Ser. No. 626,013, Dec. 12, 1990, Pat. No. 5,040,798.

[51] Int. Cl.[5] ..... A63B 69/36

[52] U.S. Cl. ..... 273/183 B; 273/189 R; 273/183 E

[58] Field of Search ..... 119/126, 127, 128; 273/183 B, 188 R, 188 A, 189 R, 189 A, 190 R, 190 A, 190 B, 190 C

[56] References Cited

U.S. PATENT DOCUMENTS

| | | | |
|---|---|---|---|
| 765,354 | 7/1904 | Boone | 119/127 |
| 3,423,094 | 1/1969 | Auslander et al. | 119/126 X |
| 3,672,682 | 6/1972 | Yanagidaira | 273/189 R |
| 4,045,033 | 8/1977 | Schuman | 273/188 R |
| 4,890,841 | 1/1990 | Brooks | 273/188 R |
| 4,896,887 | 1/1990 | Cable | 273/189 R |
| 5,040,798 | 8/1991 | Leitao | 273/183 B |

FOREIGN PATENT DOCUMENTS

| | | | |
|---|---|---|---|
| 20463 | of 1907 | United Kingdom | 273/189 R |

*Primary Examiner*—George J. Marlo
*Attorney, Agent, or Firm*—Arthur W. Fisher, III

[57] ABSTRACT

A chipping and putting practice device comprising a rigid elongated shaft and two arm attachment loops wherein the attachment loops are attached to the golfer's arms with the rigid elongated shaft laying across the inside portion of each elbow to properly align the forearms, elbows and shoulders to the intended target line to aid the golfer in achieving the proper movement and therefore the coordinated swing controlled by the large muscles of the upper body thereby conditioning the golfer to take the club straight back and then straight through the ball with the shoulders, arms, hands and club acting as a single unit.

11 Claims, 2 Drawing Sheets

CHIPPING AND PUTTING PRACTICE DEVICE

CROSS-REFERENCE

This application is a continuation-in-part application of pending application Ser. No. 626,013, filed Dec. 12, 1990.

BACKGROUND OF THE INVENTION

1. Field of the Invention

This invention relates to a training device for teaching and practicing the golf strokes of chipping and putting.

Description of the Prior Art

Fear of chipping and putting is common among experienced and inexperienced golfers alike. In the past chipping and putting has been taught by explanation and demonstration of the proper techniques, by golf instructors.

In order to provide background information, so that the invention may be completely understood and appreciated, reference is made to several prior art patents.

U.S. Pat. No. 3,672,682 discloses a stabilizer plate, which is held in place by the golfer's arms.

U.S. Pat. No. 4,896,887 shows a golfing aid using two arm restraints, each of which is located on opposite sides of a yoke, thus placing the forearm and elbow of one arm above the forearm and elbow of the other, causing the leading shoulder to become higher than the trailing shoulder.

U.S. Pat. No. 3,672,682 teaches a golf putting practice aid comprising an elongated strip or plate having the opposite ends thereof curved to be interposed between and to engage snugly against the inner portions of the golfer's arms. Since the practice aid is not secured to the golfer there is no assurance that the strip will be positioned properly berween the golfer's arms and requires the golfer to maintain an unnatural and undesirable posture by effectively wedging the practice between the golfer's arms.

U.S. Pat. No. 4,890,841 discloses a golf swing aid including a shoulder encircling elastic band secured about the shoulder to provide primary direction force for the swing and a pair of arm encircling bands depending downwardly from the shoulder encircling elastic band to engage the arms and maintain the position of the shoulder encircling elastic band during use.

British 20,463 describes a device for assisting in teaching golf consisting of the waist belt, a sliding piece coupled to the rear or back portion of a waist belt and an arm receiving loop affixed to opposite ends of the sliding piece. The use of British 20,463 requires at least a two piece stroke and allows free and unimpeded movement of the golfer's forearms and upper arms. This action negates one piece take-a-way conditioning.

U.S. Pat. No. 4,045,033 shows a golf putting aid placed between the golfer's legs comprising a rigid member having at least one pair of opposed concave side surfaces an opposed pair of concave end surfaces for engaging the legs to maintain the legs in a plurality of substantially fixed positions to steady the golfer's stance and reduce body sway.

U.S. Pat. No. 765,354 teaches the use of a series of holes for attaching elastic loops to a rigid body.

Whatever the precise merits, features and advantages of the above cited references, none of them achieve the proper alignment of the forearms, elbows and shoulders to the intended target line without any unnecessary muscle force.

The object of the present invention is a practicing device for improving the alignment of the forearms, elbows and shoulders to the intended target. This is accomplished by attaching the practice device to the golfer's arms, with the shaft laying across the inside portion of both elbows, and by visibly leveling the shaft and checking to make sure it is parallel to the intended target. The golfer's arms and shoulders are now in the correct position to take the club away from the ball as a single unit, in what is known as a one piece take-a-way. This swing is created with the use of the large muscles of the upper body, the golfer will now create a pendulum motion with the shoulders, arms and club, necessary for a one piece swing straight back and then straight through the ball.

The present invention aids in the development of the desired one piece swing movement, maintaining the forearms, elbows and shoulders in proper alignment to the intended target line, for a more uniform and accurate stroke, all of which are key elements in effective chipping and putting.

SUMMARY OF THE INVENTION

The principal object of this invention is to provide a chipping and putting practice device for use in conditioning golfers in effective chipping and putting techniques. This can be accomplished by providing a chipping and putting practice device comprising a rigid elongated shaft and attachment means for attaching the shaft to the golfer's arms. The attachment means comprises two flexible elastic cord loops which are spaced longitudinally on the same side of the rigid elongated shaft so that when the chipping and putting practice device is attached to the golfer's arms the rigid elongated shaft will lay across the inside portion of each elbow causing the golfer's forearms, elbows and shoulders to be placed in proper alignment position relative to the intended target as the golfer is addresses the ball.

In this proper position the golfer utilizes the large muscles of the upper body to take the shoulders, arms and club away from the ball as a single unit in what is known as a one piece take-a-way stroke. In order to allow for adjustments to compensate for the golfer's physical stature a plurality of apertures may be formed longitudinally along to the rigid elongated shaft to allow repositioning of the flexible elastic cord loops relative to each other. The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
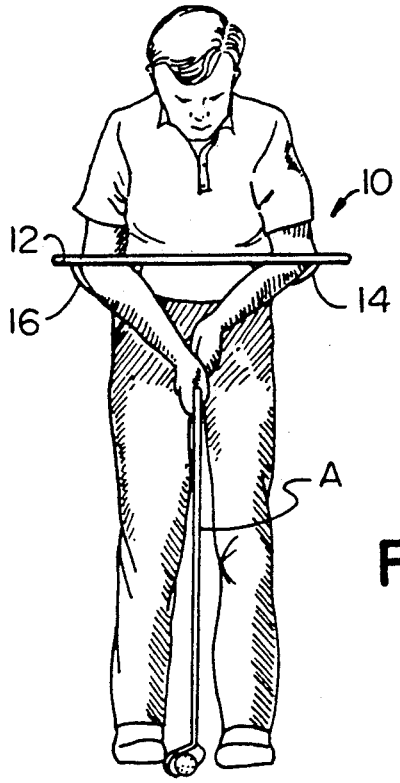
FIG. 1 is a sketch illustrating a manner in which the present invention is used for its intended purpose.

FIG. 1 shows a golfer with the chipping and putting practice device of the present invention generally indicated as 10.

Figure 2:
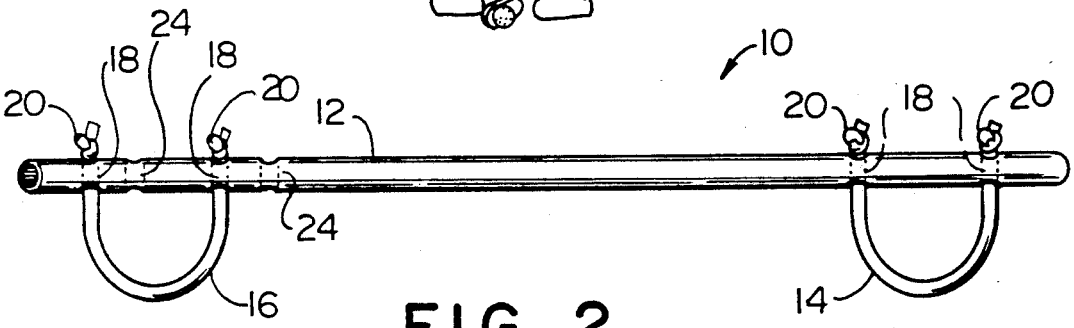
FIG. 2 is a front elevational view of a first embodiment of the present invention.

As best shown in FIG. 2, the chipping and putting practice device 10 comprises a rigid elongated shaft 12 constructed of lightweight material having an attachment means including a first and second flexible elastic cord attachment loop indicated as 14 and 16 respectively attached thereto aligned longitudinally relative to each other along the same side of the rigid elongated shaft 12 on opposite end portions thereof. Opposite ends of attachment loops 14 and 16 are passed through a corresponding pair of apertures 18 and tied as at 20 once the exact length of each attached loop 14 and 16 to securely fit the golfer's arms has been determined. In addition, the distance between the attachment loops 14 and 16 may be a fixed distance or may be adjustable with a pair of apertures each indicated as 24 to adjust the longitudinal distance between the attachment loops 14 and 16 to suit the physical stature of the golfer.

Figure 3:
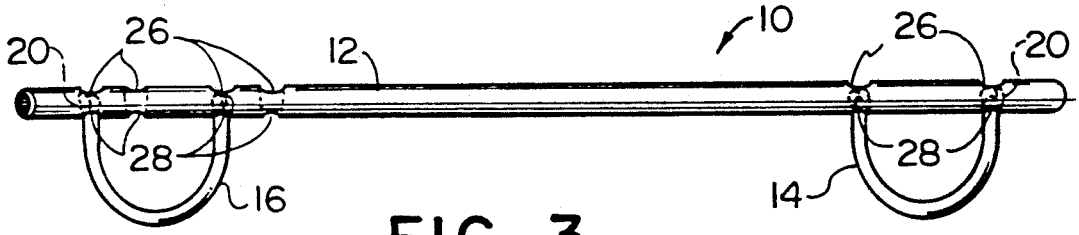
FIG. 3 is a front elevational view of the preferred embodiment of the present invention.

FIG. 3 shows a second embodiment of the chipping and putting practice device 10 comprising a rigid elongated shaft 12 constructed of a lightweight material having the two attachment loops 14 and 16 attached thereto. The attachment loops 14 and 16 are located on the rigid elongated shaft 12 as previously described. However a plurality of apertures each indicated as 26 include a larger diameter than a corresponding plurality of apertures each indicated as 28 so that the tied ends 20 of each attachment loop 14 and 16 is allowed to slip into the rigid elongated shaft 12 so as to be disposed therein.

Figure 4:
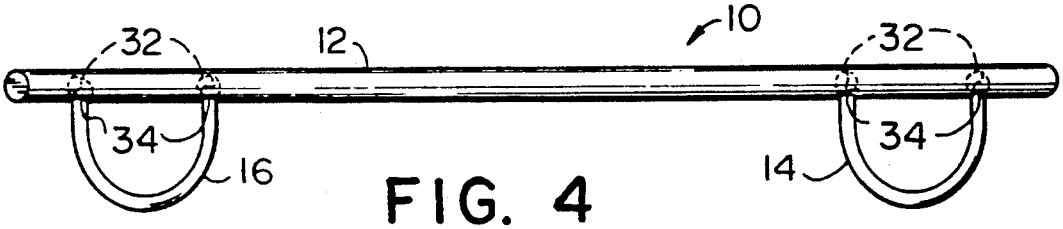
FIG. 4 is a front elevational view of a second embodiment of the present invention.

FIG. 4 is still another alternate embodiment of the chipping and putting practice device 10 comprising a rigid elongated shaft 12 constructed of a lightweight material having the attachment loops 14 and 16 attached thereto. The attachment loops 14 and 16 are located on the rigid elongated shaft 12 as previously described except that the distance between the attachment loops 14 and 16 is fixed with each end 32 of each attachment loop 14 and 16 and glued into a corresponding aperture 34.

In use, the chipping and putting practice device 10 is positioned as shown in FIG. 1 with the rigid elongated shaft 12 laying across the inside portion of each elbow. The attachment loops 14 and 16 hold the rigid elongatged shaft 12 in place on the golfer's arms to maintain each corresponding forearm, elbow and shoulder in a symmetrical/mirror image position relative to the corresponding forearm, elbow and shoulder on the opposite side of the body such that the chipping and putting device 10 restricts relative movement between corresponding forearms, elbows and shoulders to maintain the club shaft A in a substantially vertical position throughout the entire stroke.

Figure 5:
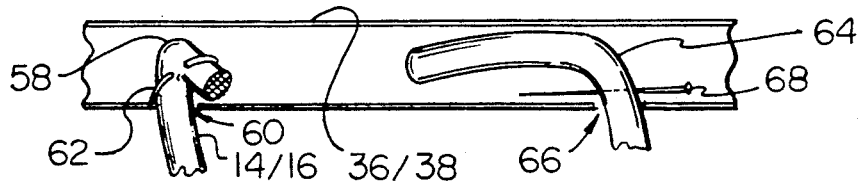
FIG. 5 is a partial view of the adjustable attachment loop.
Figure 6:
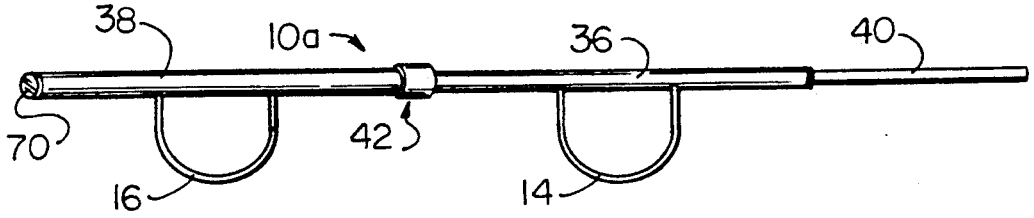
FIG. 6 is a front elevational view of a third embodiment of the present invention.

FIGS. 5 through 9 show another alternate embodiment of the chipping and putting practice device generally indicated as 10*a* comprising a collapsible rigid elongated shaft including a first and second shaft section indicated as 36 and 38 respectively disposed in telescoping relationship relative to each other, attachment means including a first and second elastic flexible cord attachment loop indicated as 14 and 16 respectively, visual alignment member 40 shown in FIG. 6 as removably mounted to the first shaft section 36 and a lock means generally indicated as 42 to selectively secure the first and second shaft sections 36 and 38 relative to each other.

Figure 9:
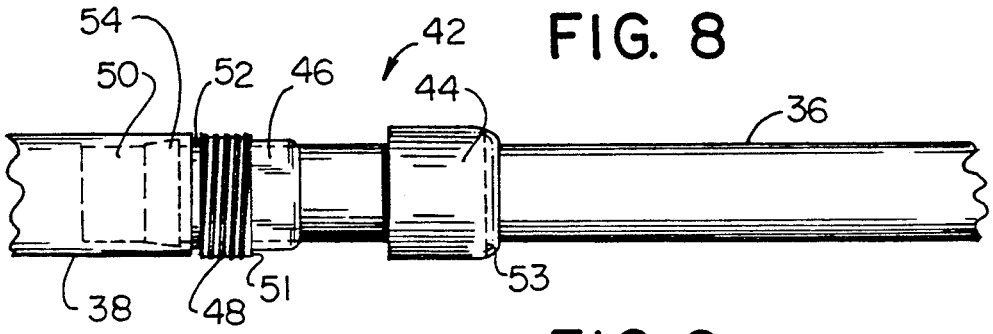
FIG. 9 is a detailed view of the shaft adjustment means of the third embodiment of the present invention.

As best shown in FIG. 9, the lock means 42 comprises a first, intermediate and second lock member indicated as 44, 46 and 48 respectively. The first lock member 44 comprises a hollow internally threaded locking clutch; while, the intermediate lock member 46 comprises a compressible locking brake. The first and intermediate lock members 44 and 46 are each slidably mounted on the first shaft section 36. The second lock member 48 comprises a plurality of external threads formed on the end portion of the second shaft section 38 adjacent the inner end portion 50 of the first shaft section 36. The first lock member 44 is movable between a first or unlocked position as shown in FIG. 9 to permit longitudinal adjustment of the first and second shaft section 36 and 38 as described more fully hereafter and a second or locked position as shown in FIGS. 6 and 7 wherein the internal threads (not shown) operatively interlock with the plurality of external threads to wedge or sandwich the intermediate lock member 46 between the outer end 51 of the second shaft section 38 and shoulder 53 found on the outer end portion of the first lock member 44.

Figure 7:
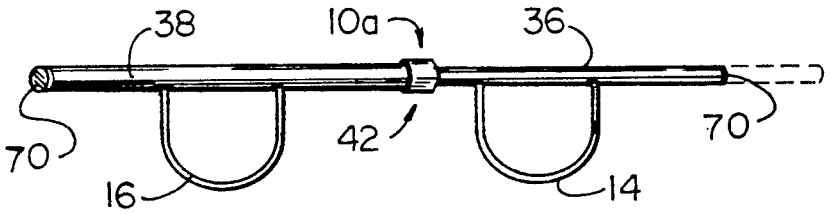
FIG. 7 is another view of the third embodiment of the present invention.
Figure 8:
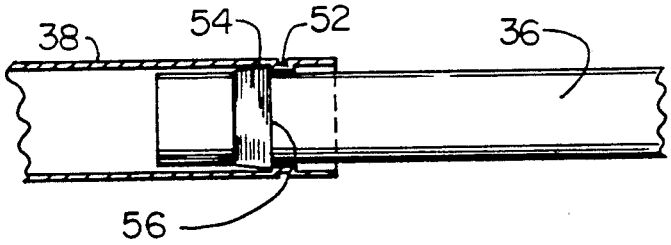
FIG. 8 is a partial cross-sectional view of the shaft adjustment means of the third embodiment of the present invention.

As best shown in FIGS. 7 and 8, the chipping and putting practice device 10 further includes a limit means to limit the outward movement of the first shaft section 36 relative to the second shaft section 38. Specifically the limit means comprises a lip or skirt 52 extending inwardly into the interior of the second shaft section 38 adjacent thereto and a limit member 54 including a limit face or shoulder 56 formed on the end portion of the first shaft section 36 disposed within the end portion of the second shaft section 38 adjacent and longitudinally inwardly of the lip or skirt 52 such that the limit face or shoulder 56 will engage the lip or skirt 52 as the first and second shaft sections 36 and 38 are moved outwardly relative to each other to prevent separation therebetween.

As shown in FIG. 5, each attachment loop 14 and 16 includes a first end 58 passed through a first aperture and secured within the collapsible rigid elongated shaft by a first securing element 62 affixed thereto and a second end 64 passed through a second aperture 66 and secured with the collapsible rigid elongated shaft by a second securing element 68 removably attached thereto.

As shown in FIGS. 6 and 7, end caps 70 may be attached to opposite ends of the collapsible rigid elongated shaft.

The distance between the attached loops 14 and 16 is adjustable by moving the first and second shaft section 36 and 38 relative to each other. Disengagement of the first lock member 44 from the second lock member 48 releases the intermediate lock member 46 to permit telescoping movement of the first and second shaft sections 36 and 38 relative to each other to accommodate the physical stature of the golfer. Once the desired length is obtained by the movement of the first and second shaft sections 36 and 38 relative to each other, the first locking member 44 is repositioned from the first or unlocked position to the second or locked position after wedging or sandwiching the intermediate lock member 46 between the outer end 51 of the econd shaft section 38 and the shoulder 53 formed on the outer end portion of the first lock member 44.

In addition, the length of the first and second attachment loop 14 and 16 is adjustable to account for the size of the upper arms of individual golfer. Specifically, the second securing element 68 is removed from the corresponding second end 64 of either the first or second attachment loop 14 or 16 and reattached to the corresponding second end 64 longitudinally along the corresponding first or second attachment loop 14 or 16 as determined by the desired length of the first or second attached loop 14 or 16.

In use, the chipping and putting practice device 10*a* is positioned as shown in FIG. 1 with the collapsible rigid elongated shaft laying across the inside portion of each elbow. The attachment loops 14 and 16 hold the collapsible rigid elongated shaft in place on the golfer's arms to maintain each corresponding forearm, elbow and shoulder in a symmetrical/mirror image position relative to the corresponding forearm, elbow and shoulder on the opposite side of the body such that the chipping and putting device 10*a* restricts relative movement between corresponding forearms, elbows and shoulders to maintain the club shaft A in a substantially vertical position throughout the entire stroke. Moreover, the end cap 70 may be removed from the first shaft section 36 to permit attachment of the visual alignment member 40 thereto. An additional visual indicator of the parallel alignment for the chipping and putting practice device 10*a*, an imaginary line between the ball and cup.

The invention has been provided with several advantages. The practice device of the invention can be used by both right and left handed golfers, is a device for improving the proper alignment of the forearms, elbows and shoulders to the intended target. By visibly leveling the shaft and also checking to make sure it is parallel to the intended target, the golfer's arms and shoulders are now in the correct position to take the club away from the ball as a single unit. The stroke is created with the use of the large muscles in the upper body, causing the golfer to create a pendulum motion with the shoulders, arms and club, all of which are key element in effective chipping and putting.

It will thus be seen that the objects set forth above among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A chipping and putting practice device comprising a rigid elongated shaft having an attachment means including a first and second attachment loop attached thereto aligned longitudinally relative to each other along the same side of said rigid elongated shaft on opposite end portions thereof to receive the golfer's arms therethrough, said rigid elongated shaft comprising a first and second shaft section disposed in telescoping relationship relative to each other to selectively vary the length of said rigid elongated shaft to adjust the distance between said first and second attachment loops relative to each other, said rigid elongated shaft having a length permitting said rigid elongated shaft to lay across the inside portion of each elbow while the golfer is addressing a golf ball for a chipping or putting stroke such that each corresponding forearm, elbow and shoulder is held in a symmetrical/mirror image position relative to the corresponding forearm, elbow and shoulder on the opposite side of the body to prevent relative movement between corresponding forearms, elbows and shoulders such that said chipping and putting device restricts relative movement between corresponding forearms, elbows and shoulders to maintain the club shaft in a substantially vertical position throughout the entire stroke whereby the golfer creates a one piece take-a-way stroke by movement of the upper portion of the golfer's body.

2. The chipping and putting practice device of claim 1 further including a lock means comprising a first lock member movable between a first and second position mounted on said first shaft section and a second lock member formed on said second shaft section such that said first lock member engages said second shaft section when in said second position to interlock said first shaft section relative to said second shaft section to prevent relative movement therebetwen and said first lock member disengages said second shaft section when in said first position to permit relative movement between said first shaft section and said second shaft section.

3. The chipping and putting device of claim 2 wherein said lock means further includes an intermediate lock member movable between a first and second position mounted on said first shaft section disposed between said first lock member and said second lock member such that said intermediate lock member is wedged between said first lock member and said second lock member when said first lock member and said second position to prevent relative movement between said first shaft section and said second shaft section.

4. The chipping and putting device of claim 2 wherein said lock means further includes an intermediate lock member movable between a first and second position mounted on said first shaft section between said first lock member and said second lock member such that said intermediate lock member is wedged between said first lock member and said second lock member when said first lock member is in said second position to prevent relative movement between said first shaft section and said second shaft section, said intermediate lock member comprises a compressible locking brake.

5. The chipping and putting practice device of claim 1 further including a lock means comprising a first lock member movable between a first and second position mounted on said first shaft section and a second lock member formed on said second shaft section such that said first lock member engages said second shaft section when in said second position to interlock said first shaft section relative to said second shaft section to prevent relative movement therebetween and said first lock member disengages said second shaft section when in said first position to permit relative movement between said first shaft section and said second shaft section, said first lock member comprises a hollow internally threaded locking clutch and said second lock member cmprises a plurality of external threads formed on the end portion of the second shaft section.

6. The chipping and putting practice device of claim 1 further including a limit means to limit the outward movement of said first shaft section relative to said second shaft section.

7. The chipping and putting practice device of claim 6 wherein said limit means comprises a skirt formed on said second shaft section and a limit member including a limit shoulder formed on the end portion of said first shaft section disposed within the end portion of said second shaft section adjacent and longitudinally inwardly from said skirt such that said shoulder will engage said skirt as said first and second shaft sections are moved outwardly relative to each other to prevent separation thereof.

8. The chipping and putting practice device of claim 1 wherein the length of said first and second attachment loop is adjustable to account for the size of the upper arms of individual golfers.

9. The chipping and putting practice device of claim 8 wherein each said attachment loop includes a first end passed through an aperture and secured to said collapsible rigid elongated shaft by a securing element removably attached thereto.

10. The chipping and putting practice device of claim 8 wherein said attachment means including a first and second flexible elastic cord attachment loop.

11. The chipping and putting practice device of claim 1 further including a visual alignment member removably mounted to said first shaft section to provide visual alignment of said rigid elongated shaft in a line parallel to the line between the golf ball and the cup.

* * * * *